US005169326A

United States Patent [19]

Werner

[11] Patent Number: 5,169,326

[45] Date of Patent: Dec. 8, 1992

[54] ELECTRIC PLUG LOCK

[76] Inventor: Theodore J. Werner, 579 Old Country Rd., Dix Hills, N.Y. 11746

[21] Appl. No.: 829,950

[22] Filed: Feb. 3, 1992

[51] Int. Cl.[5] ..... H01R 13/40

[52] U.S. Cl. ..... 439/134; 70/23; 70/314; 70/57; 439/304; 439/139; 439/892

[58] Field of Search ..... 439/133, 134, 139, 304, 439/892; 70/23, 57, 303 R, 314, 323

[56] References Cited

U.S. PATENT DOCUMENTS 2,654,073 9/1953 Katz ..... 439/134
2,733,416 1/1956 Evalt ..... 439/134
3,543,544 12/1970 Efston ..... 439/304
4,770,013 9/1988 Nakai ..... 70/314
4,860,561 8/1989 Hwang ..... 70/23

*Primary Examiner*—Paula A. Bradley
*Attorney, Agent, or Firm*—Edward H. Loveman

[57] ABSTRACT

An electric plug combination lock for locking the prongs of an electric plug thereto. The lock includes a casing enclosing a chamber having a lock subassembly therein which has a frame lock portion with lock hooks that lock into holes in the prongs of the electric plug, a spring biasing the frame lock portion to the locked position and a combination lock for preventing the frame lock from entering the unlocked position unless the correct combination is present.

10 Claims, 2 Drawing Sheets

ELECTRIC PLUG LOCK

BACKGROUND OF THE INVENTION

1. Field of the Invention

This invention relates to an electric plug lock and more particularly relates to an electric plug combination lock and more specifically relates to a electric plug combination lock having a spring-biased member with a prong-hole lock hook.

2. Description of the Prior Art

The prior art electric plug lock includes an unwired socket member and a flexible elongate tie member which has a first end thereof secured to the electric plug and a second end thereof secured to the socket member. One problem with this prior art electric plug lock is that it is relatively easy to separate and unlock the member ends from the plug and socket, so that safeguarding of the electrical plug is not assured. Another prior art electric plug lock includes a simple key lock into which an electric plug is inserted. The primary disadvantage in this type of locking is the requirement that one must carry a key.

SUMMARY OF THE INVENTION

According to the present invention, an electric plug lock is provided having a casing, and an internal combination lock subassembly disposed within the casing. The casing has a wall with first, second and third openings to respectively receive first, second and third plug prongs wherein the first and second plug prong have first and second lock holes. The combination lock subassembly has a lock member with first and second lock hooks for positioning the lock hooks in the lock holes in a locked condition and for positioning the lock hooks away from the lock holes in an unlocked condition whereby the electric plug may be separated from the plug lock.

A principal object of the present invention is to safeguard an electric plug against unauthorized use of the device attached thereto.

Another object of the present invention is to provide a protective covering over the prongs of an electric plug to prevent inadvertent damage thereto.

A further object of the present invention is to provide an electric plug lock, which locks into the plug prongs, and which has a combination number for release of the lock.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
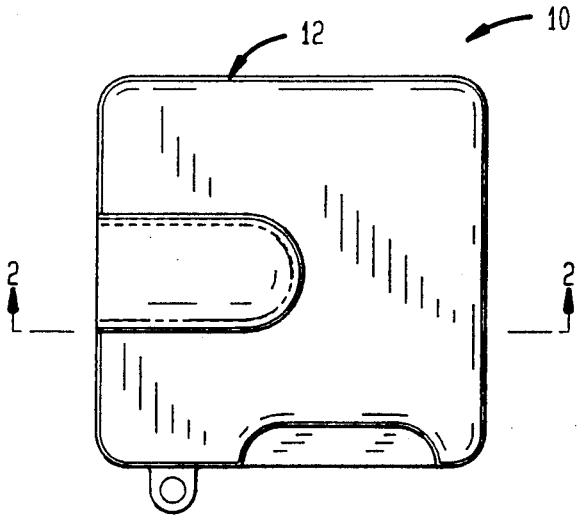
FIG. 1 is a top plan view of an electric plug lock according to the present invention.

Referring now to the drawings wherein like reference characters designate like or corresponding parts throughout, there is illustrated in FIGS. 1 through 8, an electric plug lock, generally designated as reference numeral 10, having a casing 12, and an interior combination lock subassembly 14 for locking an electric plug 16 thereto. The plug 16 has a first prong 18 with a lock hole 20 and a second prong 22 with a lock hole 24. The plug 16 also has an optional grounding pin 25.

As shown in FIGS. 1–8, the casing 12 encloses a chamber 27 (FIG. 2.), having a lower portion 29 (FIG. 3) and an upper portion 31 (FIG. 4), which are assembled together along a four-sided assembly joint 26. The chamber 27 includes a bottom wall 28, a top wall 30, a front wall 32, a rear wall 34, a left sidewall 36, a right sidewall 38, and a partition wall 40. The top wall 30 has four cantilevered posts or dowels 42, 44, 46, 48. The bottom wall 28 has four dowel holes 50, 52, 54, 56, in which the dowels 42, 44, 46, 48 are respectively press fitted when the upper portion 31 is assembled to the lower portion 29.

The lock subassembly 14 has a generally U-shaped lock frame or lock member 58 (FIG. 8) for locking the plug 16, a coil spring 60 for urging the frame 58 to a locked condition and for changing the combination number, a combination number latch 62 for latching the frame 58, and a number reset plate 64 for resetting the combination numbers.

Figure 8:
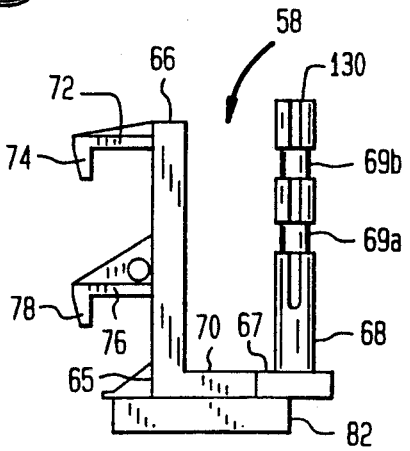
FIG. 8 is top view of the U-shaped frame 58.

The U-shaped frame 58 has an arm 66 which is rectangular in cross section, a base support 70, and a shaft 68 (FIG. 8). The base support 70 is integrally connected to one end 65 of the arm 66. Integrally formed on one end 67, of the support 70, is the shaft 68 which has two spaced apart circular grooves **69*a* and 69*b* and a longitudinal groove 130 as clearly illustrated in FIG. 8. The shaft 68 is displaceable relative to the casing 12 along an axis 80**, as will hereinafter be more specifically described.

The arm 66 has a lower lock arm 72, projecting at right angles therefrom, and a tapered projection or lock hook 74. The arm 66 also has an upper lock arm 76 projecting at right angles therefrom and spaced parallel to the lock arm 72. The lock arm 76 has a respective tapered projection or lock hook 78. When the hooks 74, 78 are inserted into the respective prong holes 20, 24 of the plug 16, the plug 16 is locked to the device 10.

The support member 70 has a bottom portion 82 which extends through an opening 84 in the front wall 32 of the chamber 27. In operation, when the correct number combination is exposed at the parting line 26, and the bottom 82 is pressed inwardly of the chamber 27, against the bias of the coil spring 60, the frame 58 is displaced, relative to the casing 12, toward the rear wall 34, thereby causing the hooks 74, 78 to withdraw from the prong holes 20, 24 of the plug 16. A release of the finger pressure on the button 82 permits the bias of the coil spring 60 to urge the frame 58 toward the wall 32, of the chamber 27, thereby causing the projections 74, 78 to lock into the prong holes 20, 24 of the plug 16.

Figure 2:
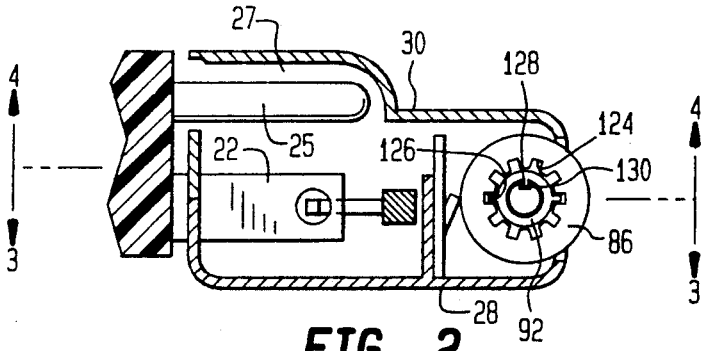
FIG. 2 is a cross-sectional view taken along line 2—2 of FIG. 1.
Figure 3:
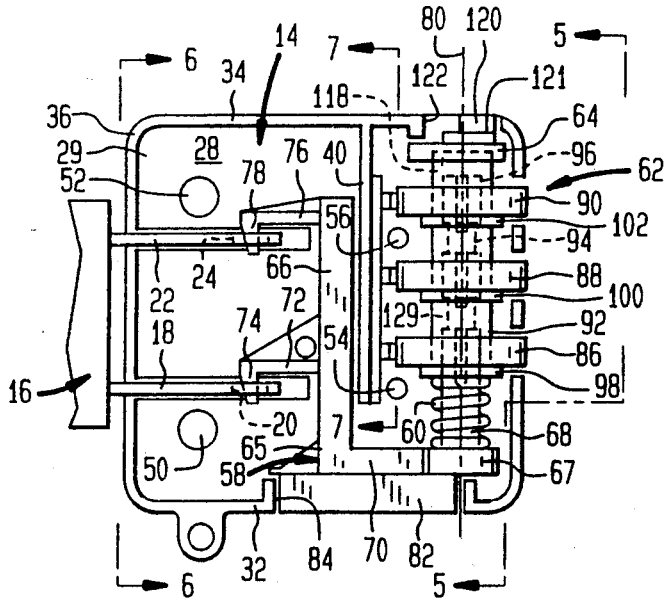
FIG. 3 is a cross-sectional view taken along line 3—3 of FIG. 2.
Figure 4:
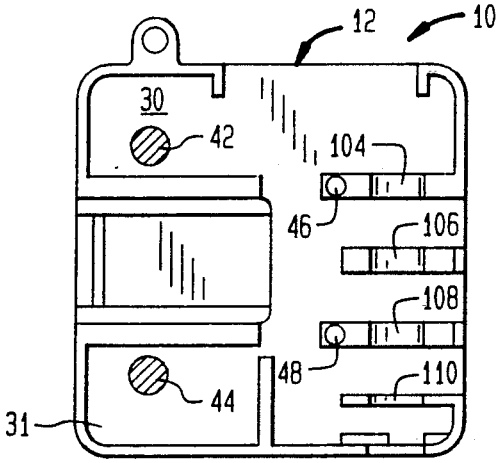
FIG. 4 is a cross-sectional view taken along line 4—4 of FIG. 2.
Figure 5:
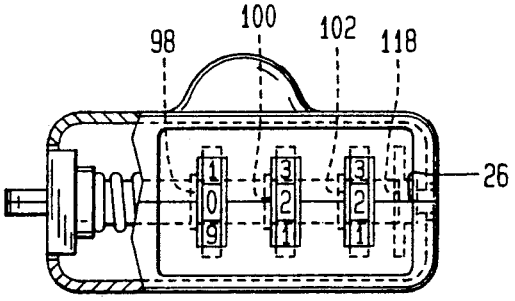
FIG. 5 is a cutaway elevational view taken along line 5—5 of FIG. 3.
Figure 6:
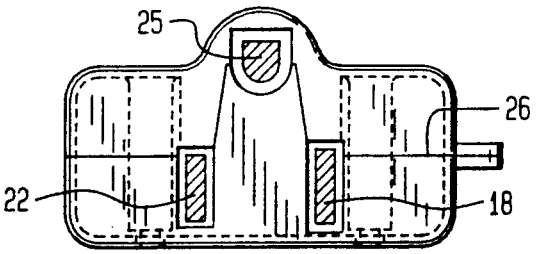
FIG. 6 is an elevational view taken along line 6—6 of FIG. 3.
Figure 7:
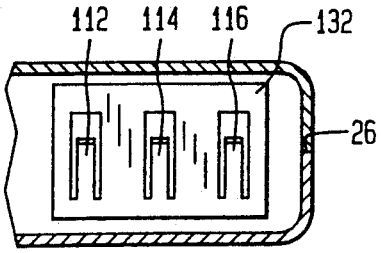
FIG. 7 is a cross-sectional view taken along line 7—7 of FIG. 3.

As best shown in FIGS. 2 and 3, the combination latch 62 has three outer dials 86, 88 and 90 which are axially spaced and which are journaled on respective middle cylinders 92, 94, 96. The cylinders 92, 94, 96 are in turn journaled on the shaft 68. Each of the cylinders 92, 94, 96 has a respective flange 98, 100, 102 at one end thereof. The spring 60 is positioned between the flange 98 of the cylinder 92 and the end 67 of the support 70. The cylinders 92, 94 and 96 each have a single tooth 128 located at the inside diameter of each of the cylinders 92, 94, and 96 and at the end thereof opposite the respective flange 98, 100, and 102. The casing 12 has four cylinder journaling pads 104, 106, 108, 110 which are fixedly to both the top wall 30 and the bottom wall 28, of the chamber 27, and which position the cylinders 92, 94, 96, axially along the shaft 68, so that normally the tooth 128 from the cylinders 92 and 94 are axially located in the grooves 69*a* and 69*b* respectively while the tooth 128 from the cylinder 96 extends over the end 68*a* of the shaft 68. When the set number combination is exposed on the parting line 26, the tooth 128 from each of the cylinders is aligned with a longitudinal groove 130 in the shaft 68 and then the frame 58 may be displaced by applying pressure to the button 82 as hereinbefore described. The latch 62 also has three dial positioning springs 112, 114, 116, which maintain the respective dials 86, 88 and 90 to a rotational position to which they have been set. As shown in FIG. 7, the positioning springs 112, 114, 116 are bent strips, which are formed, supported and cantilevered from a support sheet 132 which is held between the partition wall 40 and the dials 86, 88 and 90.

As best illustrated in FIG. 3, the dial 86, which is identical to the dials 88, 90 has ten (10) inner diameter grooves 124. The cylinder 92, which is identical to the cylinders 94, 96, has a pair of outer teeth 126, each spaced apart 180°, on the external side of the flange 98, and each of which is positioned or disposed in one of the dial grooves 124. Each of the dial grooves 124 corresponds to one of the numbers 0 through 9, which is disposed or marked on the outer surface of each of the dials 86, 88 and 90. Thus the dials 86, 88 and 90 and their respective cylinders 92, 94 and 96 are keyed together to permit simultaneous angular displacement by turning the respective dial 86, 88 or 90 to a desired number. The reset plate 64 has a circular recess 118 which receives and supports the cylinder 96. The reset plate 64 also has an actuator 120 which is received in an opening 122 in the rear wall 34. The actuator 120 has a ledge 121 which is used to keep the actuator 120 depressed without any pressure being applied thereto. Depression of the actuator 120 moves the cylinders 92, 94 and 96 toward the wall 32 by compressing the spring 60 so that the combination numbers may be changed. It should be remembered that neither the reset plate 64 or the button 82 may be moved unless the preset number combination is present at the parting line 26.

In operation, resetting of the combinations of numbers is accomplished by moving the actuator 120 inwardly of the casing 12 and moving it slightly laterally so that the ledge 121 is on the inside of the wall 34, thereby keeping the actuator depressed. The recess 118 moves the cylinder 96 toward the wall 32 which moves the cylinders 94 and 92 against the bias of the coil spring 60, to compress the same, so that the pair of teeth 126 from each of the respective cylinders 92, 94, 96, are disengaged from each of the respective dial grooves 124, in each of the respective dials 86, 88, 90, thereby permitting the same to be changed to a different number combination.

The pressure on the button 82 by an operator or user will axially displace the frame 58, toward the wall 34, by compressing the coil spring 60. This moves the tapered projections 74, 78 out of or clear of the prong holes 20, 24 in order to unlock the prongs 18, 22 of the plug 16, whereby the plug 16 may be separated from the lock device 10.

It should be understood that the foregoing relates to a limited number of preferred embodiments of the invention which have been by way of and that it is intended to cover all changes and modifications of the examples of the invention herein chosen for the purpose of the disclosure, which do not constitute departures from the spirit and scope of the invention.

What is claimed is:

1. A lock for an electric plug having a pair of spaced parallel prongs each of said prongs having an opening proximate the free end thereof, said lock comprising:

a hollow casing having a chamber therein;

a lock subassembly disposed in said chamber comprising;

a locking member means axially moveable between a locked position whereby said locking member means engages said openings in said plug and an unlocked position wherein said locking means is withdrawn from said openings; a spring means biasing said locking member to said locked position;

a combination number lock mounted on said locking member, for latching and preventing said locking member from moving axially to said unlocked position whenever the combination number is incorrect; and reset means extending out of said casing for axially moving said lock assembly against the spring bias of said spring means for changing the combination number of said combination lock when the combination lock is correct.

2. A lock as claimed in claim 1, wherein said lock casing has two openings to receive said pair of prongs from said plug.

3. A lock as claimed in claim 1, wherein said plug has a ground prong in addition to said spaced parallel prongs and wherein said casing has three holes to respectively receive said pair of prongs and said ground prong.

4. A lock as claimed in claim 1, wherein said locking member means includes a pair of spaced projections for engaging said openings in said prongs of said plug.

5. A lock as claimed in claim 4 wherein said locking member means includes a longitudinal shaft means and a support arm parallel to said shaft means and said spaced projections are parallel arms extending perpendicularly from said support arm, of said projections terminating with a lock hhok which is inserted in one of said openings of said plug when said prongs are inserted into said lock.

6. A lock as claimed in claim 1, wherein said lock subassembly further includes an actuator means distal said reset means and extending out of said casing for moving said locking member against the bias of said spring to an unlocked portion upon actuation thereof.

7. A lock as claimed in claim 6, wherein said locking member means includes a longitudinal shaft means and said reset means supports one end of said shaft means and the other end of said shaft is supported by said actuator means integrally formed therewith.

8. A lock as claimed in claim 7, wherein said reset means has a cylindrical recess for supporting said one end of said shaft.

9. A lock as claimed in claim 7, wherein said combination lock is mounted on said shaft between said actuator and said reset means.

10. A lock as claimed in claim 7, wherein said spring means is mounted on said shaft between said actuator means and said combination number lock.

* * * * *